US011135734B1

(12) United States Patent
Heumann

(10) Patent No.: US 11,135,734 B1
(45) Date of Patent: Oct. 5, 2021

(54) COMPACT HAND AXE

(71) Applicant: Sean Heumann, Black Hawk, CO (US)

(72) Inventor: Sean Heumann, Black Hawk, CO (US)

( * ) Notice: Subject to any disclaimer, the term of this patent is extended or adjusted under 35 U.S.C. 154(b) by 0 days.

(21) Appl. No.: 15/930,581

(22) Filed: May 13, 2020

Related U.S. Application Data

(60) Provisional application No. 62/851,794, filed on May 23, 2019.

(51) Int. Cl.
*B26B 23/00* (2006.01)
*B25G 3/00* (2006.01)

(52) U.S. Cl.
CPC ..... *B26B 23/00* (2013.01); *B25G 3/00* (2013.01)

(58) Field of Classification Search
CPC ..... B26B 23/00; B26B 29/025; B26B 3/06; B26B 27/00; B26F 1/00; A26B 3/005; B25D 1/00; B25F 1/02; B25F 1/006; B25G 1/24
USPC ..... 30/308.1, 308, 164.8, 340, 308.2, 308.3, 30/164.5, 314, 123.7, 298, 151, 153; 7/145, 158, 148, 159, 170, 167, 142, 144, 7/123.5, 123.2, 143; 81/22, 20, 26, 19, 81/21; D8/36, 75, 76, 98; 822/118
See application file for complete search history.

(56) References Cited

U.S. PATENT DOCUMENTS 4,283,854 A * 8/1981 Austin ..... B26B 3/06 16/430
4,546,510 A * 10/1985 Harrison ..... B26B 23/00 30/151
4,817,221 A * 4/1989 Ryan ..... B25F 1/02 30/123.7
5,315,724 A * 5/1994 Trujillo ..... B25F 1/00 7/145
D356,020 S * 3/1995 Costa ..... D8/105
D486,202 S * 2/2004 Rae ..... D22/118
7,480,964 B2 * 1/2009 Vidal ..... B25G 1/102 16/110.1

* cited by examiner

*Primary Examiner* — Ghassem Alie
(74) *Attorney, Agent, or Firm* — Duncan Galloway Egan Greenwald PLLC; Theresa Camoriano; Guillermo Camoriano

(57) ABSTRACT

Compact hand axe that can chop along multiple axes is disclosed. While utilizing the tool in the hand axe configuration the forward-facing, mid-grip trigger allows for axial rotation to occurs in user's hand around the middle finger, enabling it to achieve a far greater edge velocity/impact than would ordinarily be expected from a blade of this length. Furthermore, working in conjunction with the channeled mounting wedge, the trigger also enables the present hand axe to be mounted securely to a haft of the users choosing so that the tool's broad front edge can provide the functional yield of a full-size, dedicated axe.

1 Claim, 8 Drawing Sheets

COMPACT HAND AXE

BACKGROUND OF THE INVENTION

Axes and large knives are an essential component of every serious adventurer's gear, but these items are often large, heavy, and cumbersome. This can seriously limit an individual's ability to travel quickly and comfortably in the bush, Considering how heavy most axes and big knives are, their functional capabilities are quite limited, and most can only be used effectively by the operator when held in a single intended grip configuration. Considering these facts, the "weight to functional yield" ratio of these tools is questionable.

Most hand operated chopping implements available in the market today that are of a high enough quality, and provide great enough function to warrant their inclusion in the average camper/backpacker/survivors pack, are also quite substantial in size and weight. While these tools may do their single intended function well, they often are carried at a great energy expense to the user.

While utilizing the tool in the hand-axe configuration, the forward-facing, mid-grip trigger allows for axial rotation to occur in the user's hand around the middle finger, enabling it to achieve a far greater edge velocity/impact than would ordinarily be expected from a blade of this length/size. Furthermore, working in conjunction with the channeled mounting wedge, the trigger also enables the present hand axe to be mounted securely to a haft of the user's choosing so that the tool's broad front edge can provide the functional yield of a full-size, dedicated axe.

DETAILED DESCRIPTION

Figure 1:
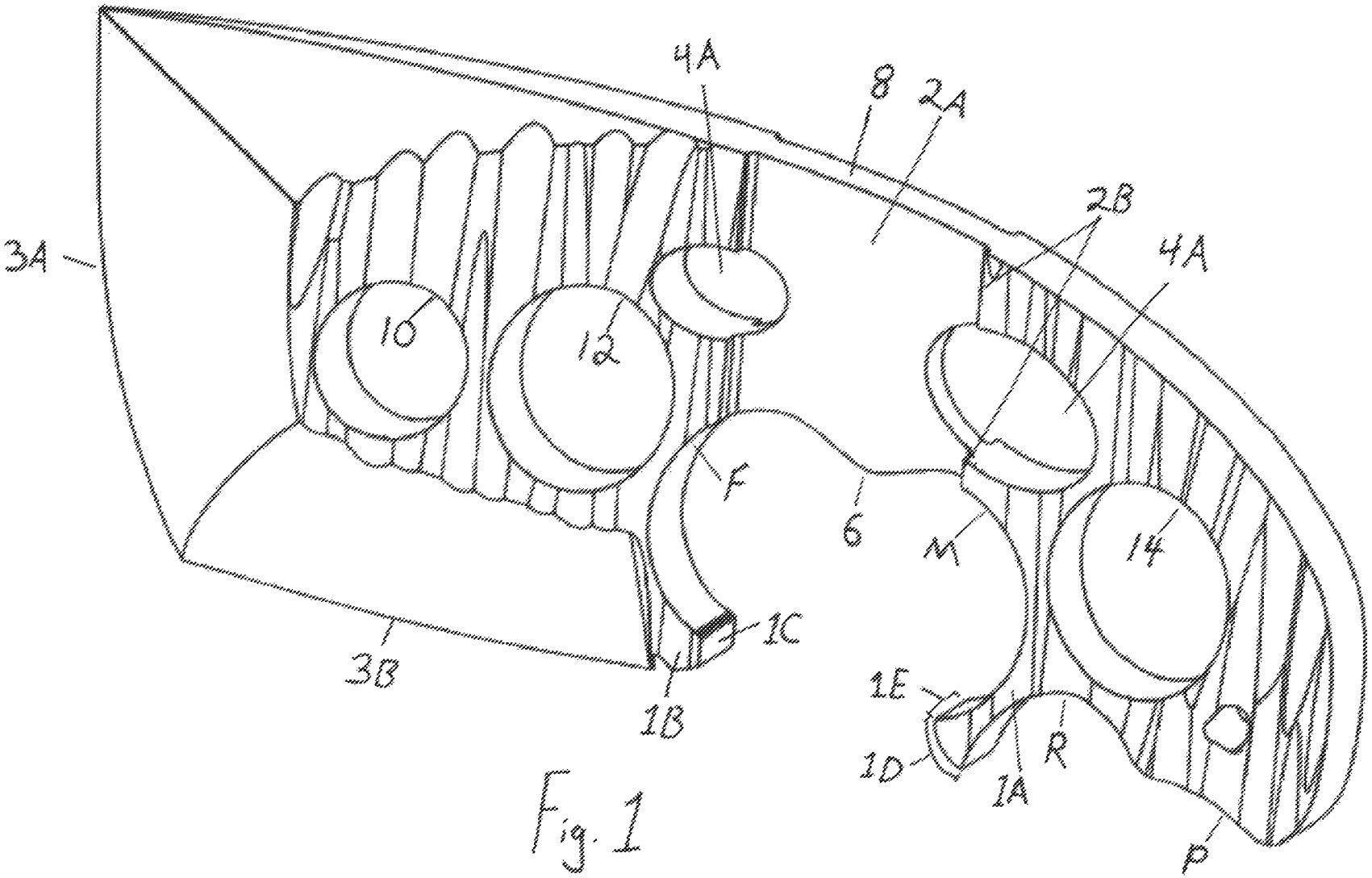
FIG. 1 is a left perspective view of a hand axe made in accordance with the present invention.
Figure 2:
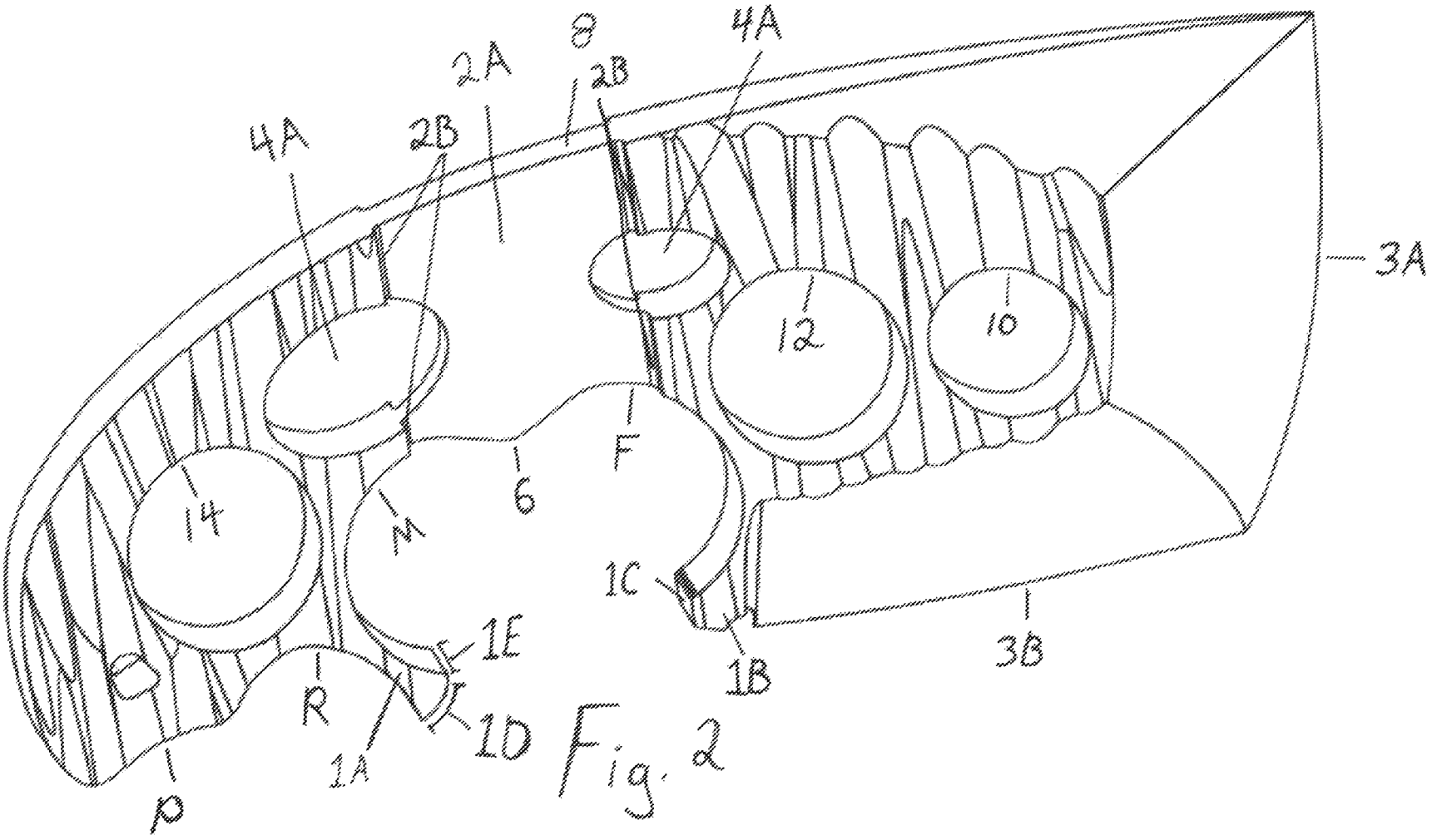
FIG. 2 is a right perspective view of the hand axe of FIG. 1.
Figure 3:
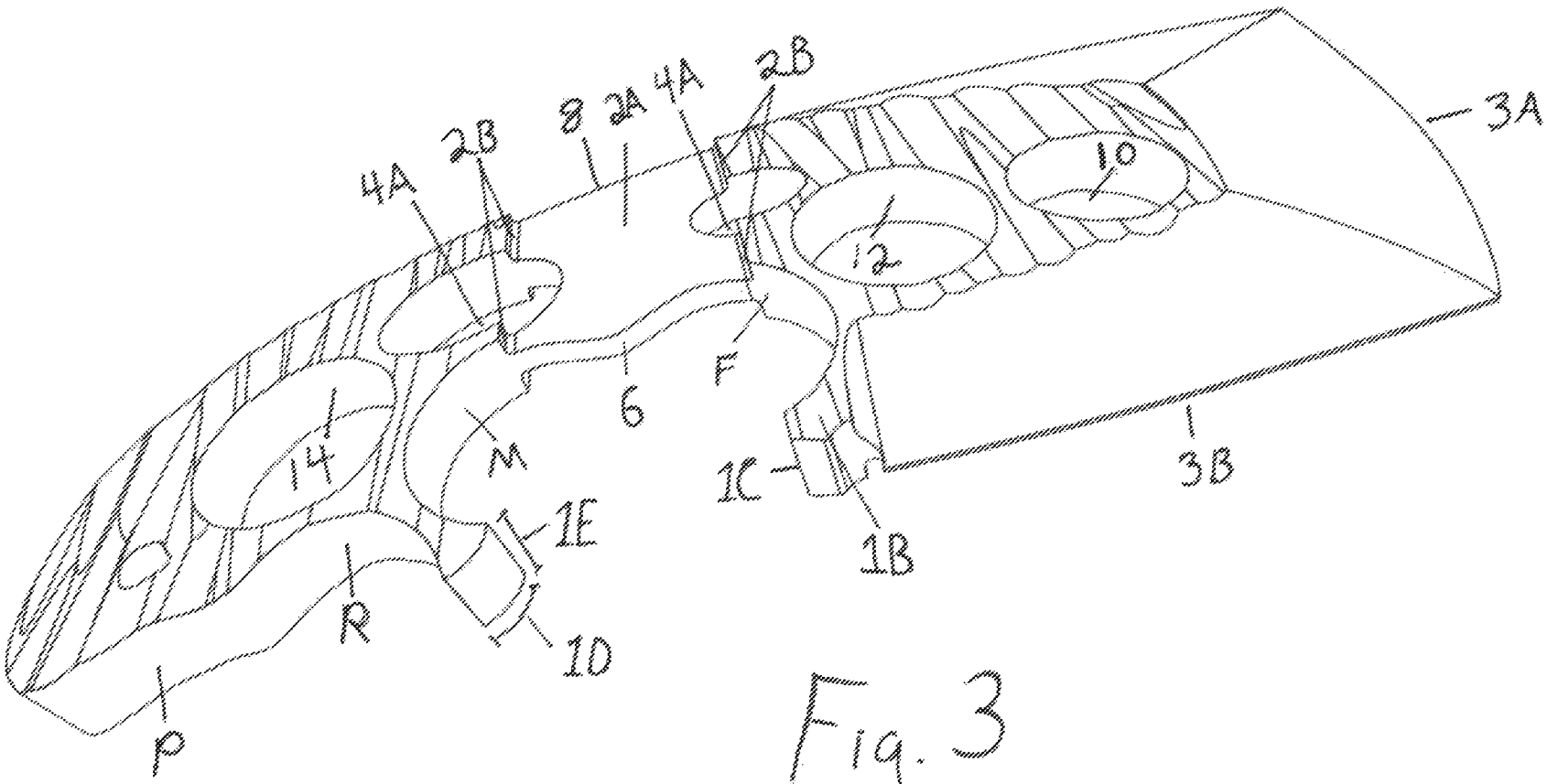
FIG. 3 is a bottom right perspective view of the hand axe of FIG. 1.
Figure 4:
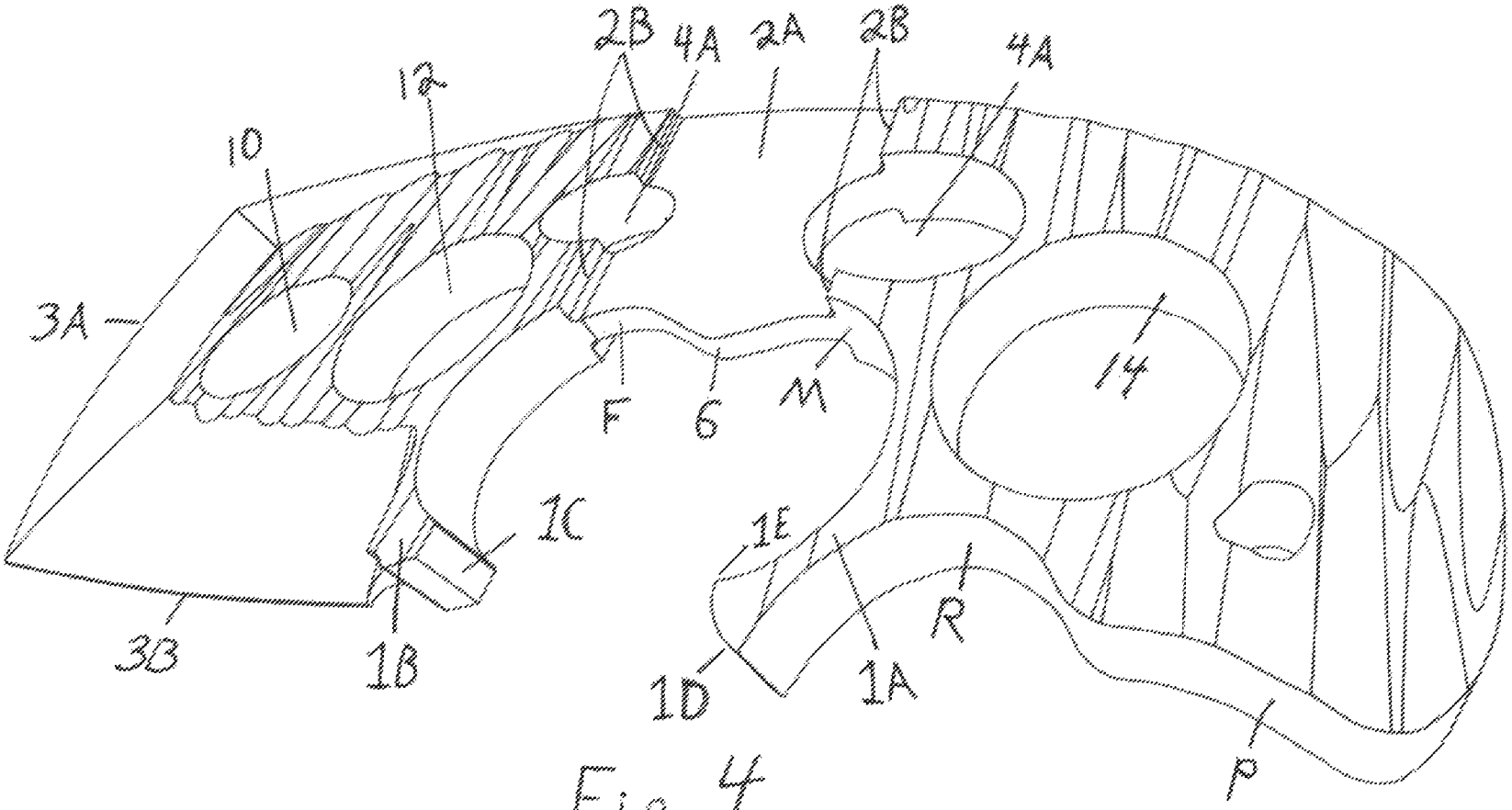
FIG. 4 is a left rear perspective view of the hand axe of FIG. 1.
Figure 5:
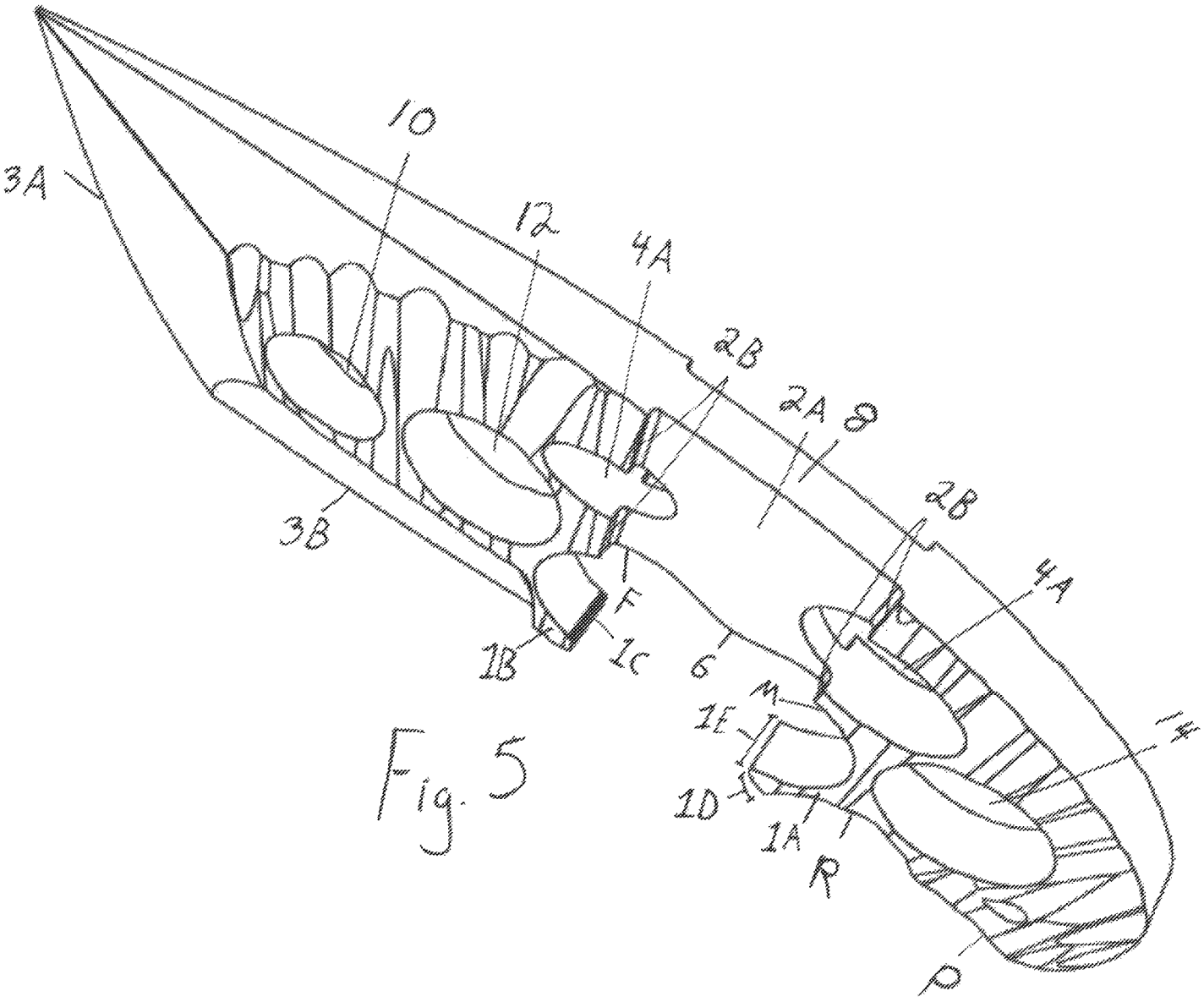
FIG. 5 is a top left perspective view of the hand axe of FIG. 1.
Figure 6:
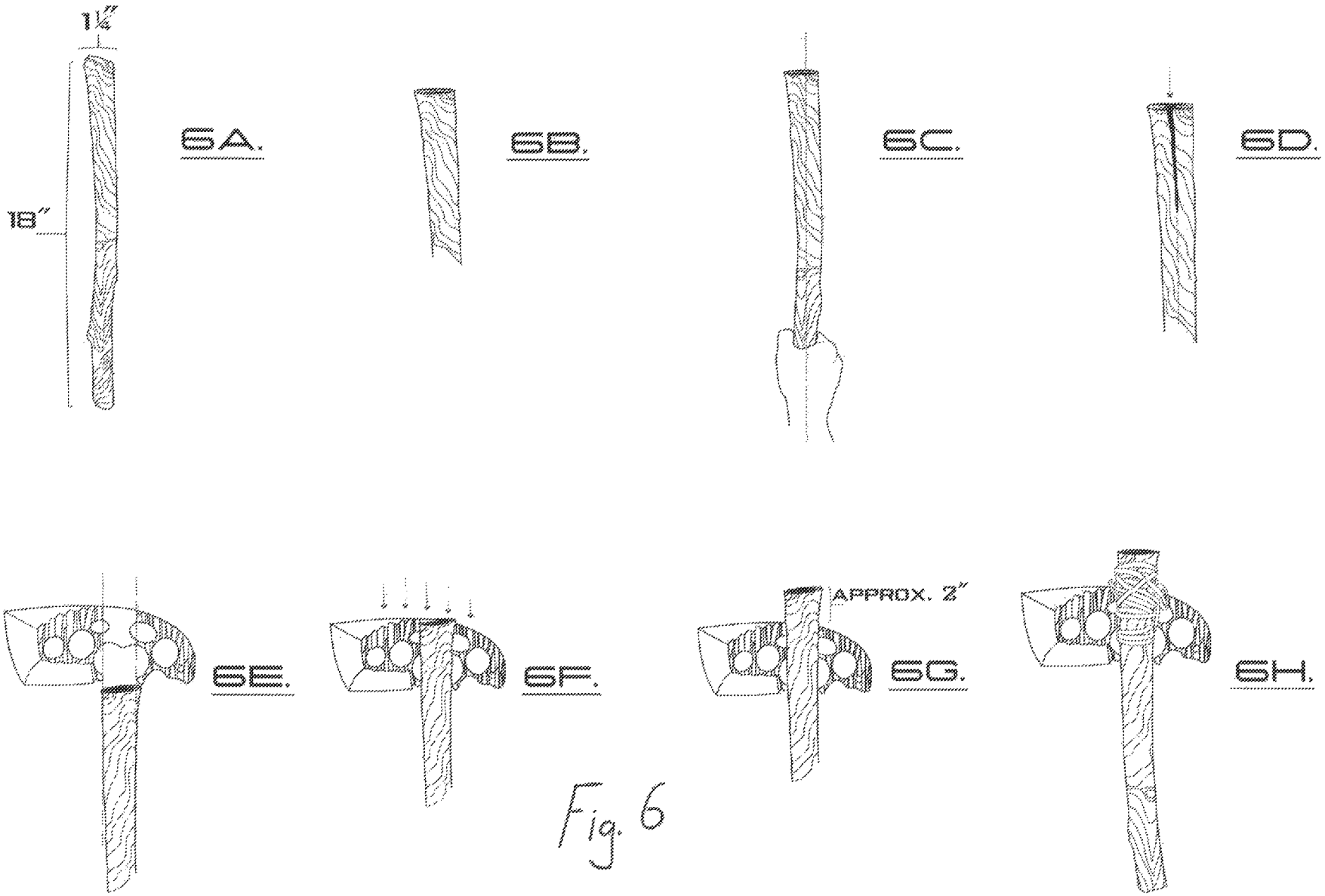
FIGS. 6A-H show the basic steps a user may follow in order to haft the hand axe of FIG. 1.

As stated above, axes and large knives are an essential component of every serious adventurer's gear, but these items are often large, heavy, and cumbersome. This can seriously limit an individual's ability to travel quickly and comfortably in the bush. Considering how heavy most axes and big knives are, their functional capabilities are quite limited, and most can only be used effectively by the operator when held in a single intended grip configuration. Considering these facts, the "weight to functional yield" ratio of these tools is questionable. The invention claimed here solves this problem.

The present hand axe can duplicate the function of (and often outperform) the traditional axe/hatchet/big knife, while being only a small fraction of the size and weight of its closest comparable counterparts.

Furthermore, the skeletonized frame allows for numerous secure grip/function combinations, regardless of a user's handedness.

The present hand axe will challenge users to reconsider their approach to chopping by providing a functional alternative to the standard big knife or axe configuration (respectively: handle with in-line blade extending lengthwise, haft with a fixed axe head).

When it comes to the gear they carry and moving quickly/efficiently in the bush, all serious adventurers know that there is a delicate "weight-of-item" to "functional-yield" balance that must be maintained. Meaning, if a tool can't provide a great enough number of valuable functions relative to its weight, then it isn't worth carrying. Prior to the present hand axe, the sizable heft of traditional hand operated chopping tools was considered a "necessary evil" since no alternative had emerged that could duplicate their function while reducing their weight.

While utilizing the present tool in the hand axe configuration, the forward-facing, mid-grip trigger allows for axial rotation to occur in the user's hand around the middle finger, enabling it to achieve a far greater edge velocity/impact than would ordinarily be expected from a blade this size. Furthermore, working in conjunction with the channeled mounting wedge, the trigger also enables the present hand axe to be mounted securely to a haft of the user's choosing so that the tool's broad front edge can provide the functional yield of a full-size, dedicated axe.

Figure 8:
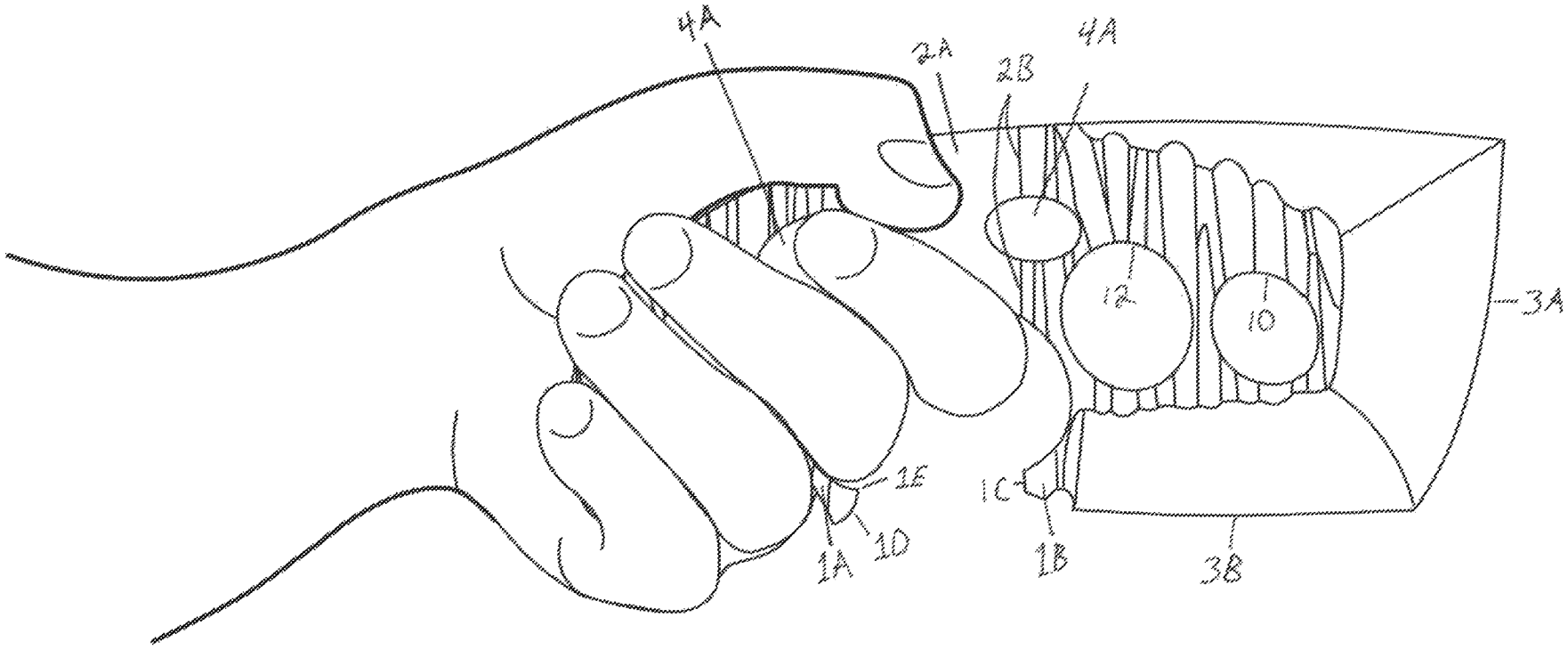
FIG. 8 is a right side view of the hand axe of FIG. 1 being held by the left hand of an operator in the hand axe configuration.

In the embodiment shown in FIGS. 1-8, a single piece of roughly ⅜ inch thick steel is reduced through machining to produce a skeletonized body/frame of a hand axe. The hand axe has a plurality of holes 4A, 10, 12, 14 through the body; it also has a plurality of indentations in its perimeter F, M, R, P, and it has front and bottom chopping edges 3A, 3B, which run along perpendicular axes. It includes forward and rear facing triggers 1A, IB. The forward facing trigger 1A has a curved front side 1D and a leading edge 1E. The central portion of the axe defines a channeled mounting wedge 2A. The front and rear edges or shoulders 2B of the channeled mounting wedge serve to direct the haft properly during mounting and lock it in place when hafted. The lashing holes 4A overlap the mounting wedge 2A, Hand Axe Configuration:

As a stand alone hand axe (without a haft) the skeletonized frame with multiple openings allows for a number of grip configurations so that the two cutting edges 3A, 3B can be utilized for any number of functions across a wide array of fields. However, its primary function as an ultra-compact chopping device may be performed if the user holds the tool in a specific configuration, as shown in FIG. 8, In order to operate the tool as intended, the user grasps the terminal end of the integral grip along the outside of the tool so that the users pinky and ring finger are rearward of the forward-facing trigger 1A along the butt of the tool at the locations P (pinky) and R (ring), respectively. The user's middle finger and forefinger rest on the positions M (middle finger) and F(forefinger) inside the recessed edge portion between the forward-facing trigger 1A and rearward-facing trigger 1B (in the space where the haft can be mounted for use in a different configuration as described later).

At this point, the user's hand is closed around the butt end of the tool, with no fingers through any ringed openings. If held properly, the angle between the user's knuckles and the belly edge 3B of the tool should be roughly 150°. This grip configuration is akin to a pistol grip, and the chopping motion that ensues is akin to a "pistol whip". The user swings the tool in a chopping motion perpendicular to the surface being cut, allowing the natural forward heft of the tool to rotate axially in the hand around the middle finger to achieve a far greater edge velocity/impact than would ordinarily be expected from a tool of this size. The user may hold the tool in either the left or right hand for this configuration.

Full-Sized Hafted Axe Configuration

Figure 7:
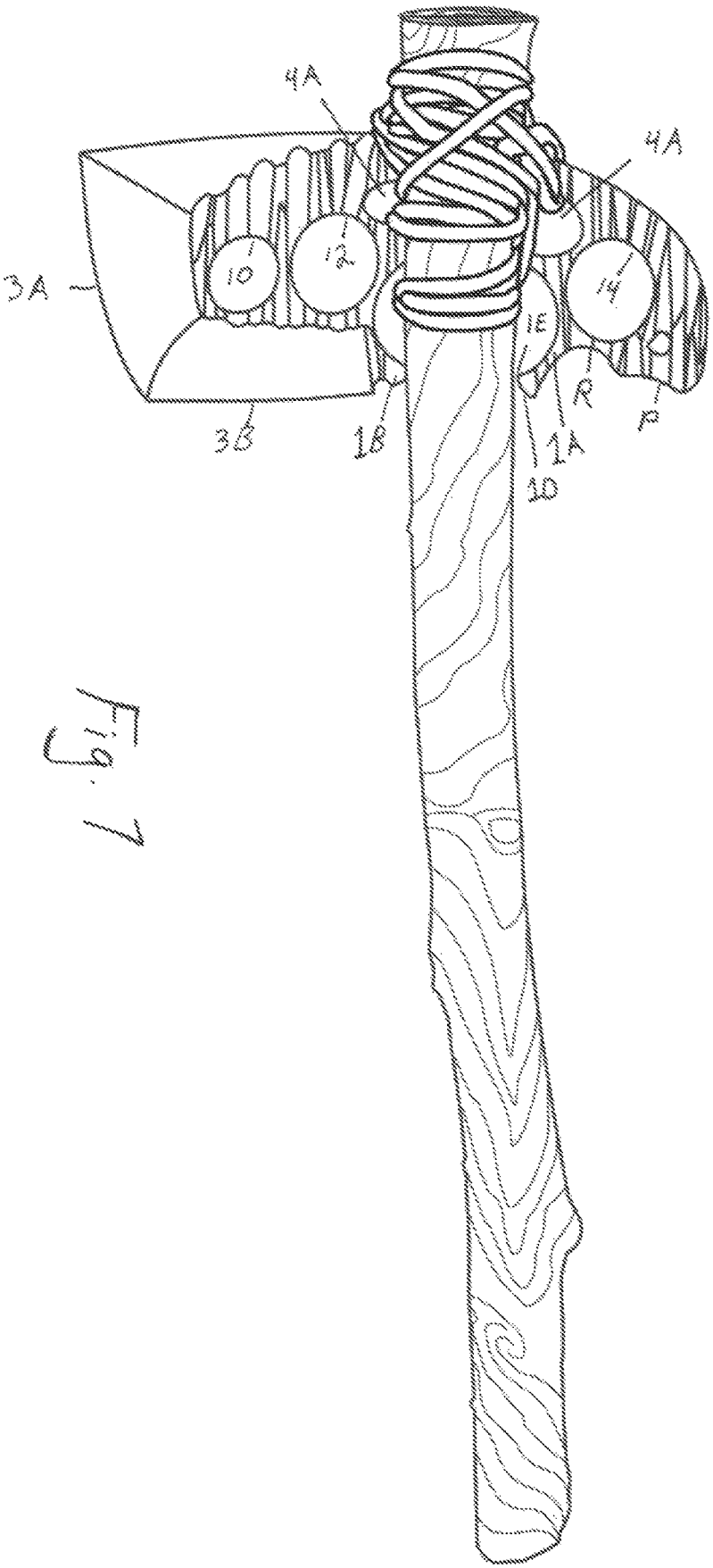
FIG. 7 is a left side view of the hand axe of FIG. 1 when hafted.

FIG. 7 shows the present hand axe mounted on a haft, and converted into a full size axe. This is accomplished through the steps shown in FIGS. 6A-6H. First, the user out in the field selects a hardwood sapling from which to chop a haft. This sapling should be equal in thickness to the opening at the center of the implement between the forward-facing trigger 1A and the rearward-facing trigger 1B (roughly 1¼ inches). The user then chops the sapling to a desired length for a given job (18 inches is adequate for most tasks), as shown in FIG. 6A. The user then flattens and smooths (to the best of one's abilities) the top end of the sapling (haft) on which the tool is to be mounted as shown in 6B. The user may use the present hand axe to pre-split the sapling (haft) down the first few inches, as shown in FIG. 6D. As shown in FIGS. 6E-G, the user then slides the channeled mounting wedge 2A into the fresh split, making sure the mounting wedge 2A and the sapling/haft split are directly in-line with each other. The mounting wedge 2A tapers from its thinner (⅛") belly edge 6 to its thicker (¼") spine edge 8.

Front and rear shoulders 2B extend along the front and rear edges of the mounting wedge 2A and have a thickness (⅜") that is thicker than the mounting wedge 2A, so that the mounting wedge 2A forms a channel between the thicker front and rear shoulders 2B. The front and rear shoulders 2B are spaced apart the same distance as the forward and rear facing support triggers 1A, 1B and lie directly above the forward edge 1E and rearward edge 10 of the front and rear triggers 1A, 1B, respectively, so the front and rear shoulders 2B and the support triggers 1A, 1B will "book-end" the front and rear edges of the sapling/haft and aid the tool in properly aligning the mounting wedge over the split, as well as serve as front and rear stops to lock the sapling/haft in place.

Using another branch or log, the user gently taps along the spine 8 of the present hand axe, working both the front and back of the tool until it is securely nested in the base of the split. Roughly 2 inches of haft should extend above the tool. The front and rear shoulders 2B work in conjunction with the support triggers IA,IB to hold the present hand axe firmly in place on the sapling (haft). The natural compression of the partially split wood should also aid in holding the tool on the sapling (haft).

Next, using a good measure of cordage, the user begins to wrap/weave the cord through the forward and rear lashing holes 4A and around the sapling/haft in order to create a super tight/secure hold. It should be noted that the front lashing hole 4A extends both forwardly and rearwardly of the front shoulder 2B, so that it extends into the area of the mounting wedge 2A. Similarly, the rear lashing hole 4A extends both forwardly and rearwardly of the rear shoulder 2B, so that it extends into the area of the mounting wedge 2A. This enables the cord to be tightly wrapped around the front and rear edges and the left and right sides of the haft.

At least some of these wraps go around the haft above the tool and around the haft below the tool in order to pull the two halves of the haft closed and securely sandwich the present hand axe in place. Once tied, the present hand axe is ready for use.

How to Make the Present Hand Axe:

One way of making the present hand axe is to start with a roughly ⅜ inch sheet of steel, and then cut the sheet using a wire cutter, water jet, a plasma cutter, or comparable means to the desired outer perimeter shape. This cutting could alternatively be done by hand (forging or via mechanical hand cutters) but would be time consuming. Once a blank has been made, CNC machining could be utilized to reduce the blank to the desired form, including the bevels, chamfers, and the mounting wedge with forward and rear shoulders. Any desired surface texturing also could be created via CNC, if desired. Of course, all of these steps alternatively could be done by hand. The preferred way to create the surface texture is through cold forging. For this process, dies containing a negative of the required surface texture are first created so that the texture can be pressed into the blank. The surface texturing is aesthetic and can be altered or left off entirely without altering the functionality of the tool to any great degree. Following this step, the blank will be heat treated so that the tool is appropriately hardened to retain sharpened edges without making the overall frame brittle and susceptible to impact related breakage. Next, the tool receives a Titanium Nitride coating (Tin). Alternatively, or in addition, a surface protectant could be used such as Cerakote. Following this, the bladed edges will receive their secondary bevels/sharpened edges, and final polishing will be completed. Of course, other known methods could be used.

As shown in FIG. 7, when the tool is mounted onto a haft, the forward-facing trigger 1A braces against the back of the haft/handle and keeps the front edge of the axe 3A squared and secure during impact. Since the forward-facing trigger 1A is still the same thickness as the steel from which it was cut (⅜ in), it will always be wider than the split in the haft, which is at maximum the width of the top of the mounting wedge 8 (¼ in). Thus, the trigger(s) 1A,1B keep the present hand axe from pulling/pushing through the split under heavy use. In addition, the curved front surface 1D at the terminal end of the forward-facing trigger 1A is angled such that it gradually reduces the space to the opening of the mounting wedge 2A. As shown in FIGS. 1 and 7, the bottom edge of the trigger 1A is spaced farther-away from the vertical axis of the mounting wedge 2A than is the top edge of the trigger 1A, thus reducing the space between the triggers 1A, 1B from the bottom toward the top, or creating a "reduction in space". The unidirectional flow suggested by this reduction in space works in a similar fashion to a "Chinese finger trap". When mounting the tool onto a handle, the haft naturally wants to follow the curved front surface 1D of the forward facing trigger 1A as it guides it into the narrowing opening which leads into the wedge 2A. At the top of the curved front surface where it terminates leaving an edge 1E, the opening to the mounting wedge 2A (the space between the triggers 1A and 1B) has been reduced to the same dimensions as the dimension between the front and rear shoulders 2B of the wedge itself, which creates a tight fit on the haft. When the hafted tool is swung, the inherent inertia would suggest that the tool might fly off the end of the haft. However, while the curved front surface 1D of the forward facing trigger makes it easy to mount the tool/insert the haft, the sharper leading edge 1E of the trigger 1A serves as a "haft retainer" and bites into the wood in the reverse direction when the user attempts to decouple the tool from the haft.

The front and rear shoulders 2B extend the full length of the mounting wedge 2A and, in this embodiment, are ⅜ of an inch thick so that a mechanical lock is created between these channels and the two halves of the split haft that sit within them. Since the mounting wedge in this embodiment is ¼ of an inch thick along the spine of the present hand axe, the haft split will be equivalently wide at its widest point. Reducing the thickness of the present hand axe through the mounting wedge 2A also helps avoid over-splitting the haft when mounting the tool.

When the present hand axe is mounted on a haft, the openings through the body of the tool allow for the user to secure/lash it to the haft in a wide array of configurations based off of the users preference/lashing material length. It is very easy to achieve a high degree of security with minimal lashing material. Unlike stone-age, flint axes which had to be lashed in an "><" pattern, the present axe can be lashed in an "><><" pattern which means even compression of the haft-splits can be applied along the entire length of each split (vs just at the top and bottom as on a stone age axe).

As a result of using ⅜" thick steel, finger holes 10, 12, 14 can be strategically placed in locations that have otherwise been unachievable in previous designs, because they would have rendered the tool structurally unsuitable for the stresses of heavy use. Skeletonized with several holes, the present hand axe can be held in an unprecedented number of grip options which Will allow the user to utilize the tool for a number of functions that otherwise could not be achieved by a single tool. For example, the user could put their first finger through the hole 10, their middle finger through the hole 12, and their thumb on the spine 8 to use the front point of the belly edge 3B for focused cutting tasks that require a high degree of control and precision as a knife. A user could alternatively shift their grip to the hand axe configuration FIG. 8 in order to utilize the belly edge for general knife tasks such as shaving wood, while simultaneously keeping their hand/knuckles safely clear of any material coming over the edge during use. Pressure chopping with the front edge 3A can be achieved by holding the present tool in a reverse grip so that the pointer finger lies in the finger recess P, and the middle finger rests in R. Meanwhile the ring and pinky finger occupy the open spaces M and F (respectively). These are just a few grip/usage examples from many which are possible with the present tool.

The trigger mechanisms 1A, 1B have the dual function of being both finger guards and support struts depending on which edge is being engaged. When the user engages the belly edge 3B of the present hand axe, putting his fingers on the curved portions F, M, for normal knife uses, the triggers 1A,1B serve as a guard for the user's fingers. When the present hand axe is used in conjunction with a haft as a full size axe, as shown in FIG. 8, for chopping with the perpendicular front edge 3A, these triggers 1A,1B serve as stabilizers/structural reinforcement points for the haft.

When this axe is used without the haft, the handle is integral to the blade. —Unlike traditional use knives, the present hand axe is exceptionally broad from top to bottom (3 in). This allows for nearly 5½ inches of total edge length along two axes (along the front edge 3A and the bottom edge 3B). Additionally, the broad profile allows the grip to be integral to the blade itself, so that the two are effectively occupying the same space simultaneously. This allows for 6" of grip to be coupled with 5½" of usable edge, all from a tool that is 7" overall in length.

While specific dimensions and arrangements are shown and described herein, it is understood that this is just one example of the present invention. It will be obvious to those skilled in the art that modifications may be made to the embodiment described herein without departing from the scope of the invention as claimed.

What is claimed is:

1. A convertible hand axe, comprising:

a one-piece body, defining a front end; a butt end; a spine edge; and a belly edge, wherein said front end defines a front edge blade and a belly edge blade; said body defining a mounting wedge extending from said belly edge to said spine edge, said mounting wedge having a thin width at said belly edge and tapering to a thicker width at said spine edge; said body defining a front shoulder extending along the front of said mounting wedge and a rear shoulder extending along the rear of said mounting wedge; said body also defining a front cord opening forward of said mounting wedge and a rear cord opening rearward of said mounting wedge, each of said front and rear cord openings extending inwardly into said mounting wedge, such that a cord may be wrapped through said front and rear cord openings and around said mounting wedge if desired; said body also defining a curved recess directly below said mounting wedge, said curved recess defining part of said belly edge and being configured to receive the first finger and middle finger of a human user; and said body defining a forward-facing trigger and a rear-facing trigger below said curved recess.

* * * * *